US009771762B2

(12) United States Patent
Baudoin

(10) Patent No.: US 9,771,762 B2
(45) Date of Patent: Sep. 26, 2017

(54) DOWNHOLE SEPARATION APPARATUS AND METHOD

(71) Applicant: KLX ENERGY SERVICES LLC, Houston, TX (US)

(72) Inventor: Toby Scott Baudoin, Rayne, LA (US)

(73) Assignee: KLX Energy Services LLC, Houston, TX (US)

( * ) Notice: Subject to any disclaimer, the term of this patent is extended or adjusted under 35 U.S.C. 154(b) by 364 days.

(21) Appl. No.: 14/615,883

(22) Filed: Feb. 6, 2015

(65) Prior Publication Data

US 2015/0226018 A1 Aug. 13, 2015

Related U.S. Application Data

(60) Provisional application No. 61/937,222, filed on Feb. 7, 2014.

(51) Int. Cl.
*E21B 17/06* (2006.01)
*E21B 17/046* (2006.01)
*E21B 31/00* (2006.01)

(52) U.S. Cl.
CPC ..... *E21B 17/06* (2013.01); *E21B 17/046* (2013.01); *E21B 31/00* (2013.01)

(58) Field of Classification Search
CPC . E21B 7/06; E21B 7/042; E21B 7/046; E21B 17/06; E21B 17/042; E21B 17/046
USPC ..... 166/242.6
See application file for complete search history.

(56) References Cited

U.S. PATENT DOCUMENTS

| | | | | |
|---|---|---|---|---|
| 4,452,472 | A * | 6/1984 | Crase | E21B 4/02 285/18 |
| 5,419,399 | A | 5/1995 | Smith | |
| 6,053,250 | A * | 4/2000 | Echols | E21B 17/06 166/242.7 |
| 6,439,305 | B1 * | 8/2002 | Bakke | E21B 17/06 166/242.6 |
| 7,152,674 | B2 | 12/2006 | Bowles | |
| 7,174,963 | B2 | 2/2007 | Bertelsen | |
| 7,650,946 | B2 * | 1/2010 | Gazewood | E21B 17/06 166/242.6 |
| 8,418,771 | B2 | 4/2013 | Sach | |
| 8,464,788 | B2 | 6/2013 | Stanford | |
| 9,267,338 | B1 * | 2/2016 | LeBlanc | E21B 17/06 |
| 2013/0075110 | A1 | 3/2013 | Shaw et al. | |
| 2014/0060854 | A1 * | 3/2014 | Baudoin | E21B 23/03 166/377 |
| 2014/0110129 | A1 * | 4/2014 | Schmidt | E21B 23/04 166/377 |

* cited by examiner

*Primary Examiner* — Kenneth L Thompson
(74) *Attorney, Agent, or Firm* — Drinker Biddle & Reath LLP

(57) ABSTRACT

A downhole separation apparatus for releasing a pipe string from a bottom hole assembly is disclosed. The apparatus has a tubular collet body, a tubular bottom sub, and a piston collet positioned within the collet body. The collet piston has a plurality of collet fingers threadedly engaging an internal profile of the bottom sub. Separation is accomplished by pumping a circulation ball through the pipe string until it lands on a ball seat inside the collet piston. Increasing fluid pressure then shifts the piston collet axially downward within the collet body thereby causing the collet fingers to collapse to disengage the bottom hole assembly from the pipe string.

19 Claims, 4 Drawing Sheets

DOWNHOLE SEPARATION APPARATUS AND METHOD

PRIORITY

This application claims priority to U.S. provisional application Ser. No. 61/937,222 filed Feb. 7, 2014 entitled "Downhole Separation Apparatus and Method", the entire content of which is hereby incorporated by reference.

FIELD OF THE INVENTION

This invention pertains to downhole equipment for oil and gas wells. More particularly, it pertains to a downhole separation apparatus for use on a wellbore pipe string such as a coiled tubing string and., more particularly, this invention relates to an apparatus for separating the upper portion of a pipe string from the lower portion of the pipe string and bottom hole assembly or BHA.

BACKGROUND OF THE INVENTION

During the drilling, work over, or plug and abandonment of oil and gas producing wellbores, a variety of downhole tools may be attached to the lower portion or bottom hole assembly of a pipe or coiled tubing string. The attached tools are utilized to perform various functions within the wellbore and the bottom hole assembly may be provided with a variety of stabilizers, reamers, hole deviation devices, drill collars, and the like that enhance the wellbore characteristics such as its shape, geometry and direction.

It is often desirable to release the lower portion or bottom-bole of a pipe or coiled tubing pipe string from the upper portion when the lower portion is still in the wellbore. This occurs when a tool is inserted in the wellbore on the pipe string and released in order to provide some function after the pipe or coiled tubing string is removed. It also occurs when a tool or the BHA becomes stuck in the wellbore and the pipe or coiled tubing string must be removed from the wellbore, independent of the tool or BHA so that a fishing tool string may be placed in the wellbore in order to try to retrieve the stuck tool or BHA, The upper and lower portions of a pipe or coded tubing pipe string are typically released from each other by an intervening tool separation device that has detachable upper and lower sections or subs.

Some tool separation devices have mechanical separation mechanisms that employ shear pins or shear screws as a principal component of the release mechanism. Such separation devices have a number of shortcomings. The shear pins of these devices may prematurely separate when the pipe of coiled tubing string is in the wellbore causing the unintended release of the attached tool or BHA. A separated portion of a shear pin may also jam the release mechanism impeding or preventing, the release of the attached tool. There is also the risk that a shear pin or a separated portion of a shear pin will stray into and remain in a lower or bottom sub portion of the separation device after separation from the pipe or coiled tubing string. A separated shear pin in the bottom sub of a separation device may prevent or impede reengagement of the upper portion of the tool separation device with the bottom sub portion at a later time.

The majority of tool separation devices have hydraulic separation mechanisms which also have shortcomings. The hydraulic separation mechanisms of many of these tool separation devices often utilize a collet mechanism that is released by a piston or ball. The piston or ball of these mechanisms is often left in the lower or bottom sub portion of the separation device when the upper portion is released. A ball left in the bottom sub portion may prevent an operator from subsequently circulating fluid through the bottom sub. The hydraulic separation mechanisms of other such devices suffer from unreliable tool release mechanisms or require high pressures to release a tool from the pipe or coiled tubing string.

Consequently, there is a need for a new tool separation apparatus having improved piston and collet configurations that will reliably release a tool or BHA from a pipe or coiled tubing suing without the aforementioned negative attributes.

SUMMARY OF THE INVENTION

The present invention provides a tool separation apparatus that satisfies the aforementioned needs. The separation apparatus is comprised of a collet body, a bottom sub, and a piston collet positioned within the collet body. Collet fingers on the upper end of the piston collet are releaseably retained on an internal abutment surface at the upper end of the collet body. The collet body has a plurality of collet fingers at its lower end that are threadedly engaged with the internal profile of the upper end of the bottom sub. The upper end of the collet body is attached to a pipe string the lower end of the collet body and the lower end of the bottom sub is attached to a tool or a bottom hole assembly.

The piston collet contains an internal profile such that a circulation bail of a given size will seat and substantially block the circulation of fluid through the separation apparatus and fluid pressure in the pipe strata, and piston collet above the circulation bail. When the increased fluid pressure in the piston collet exceeds the gripping, force exerted by the collet fingers of the piston collet on the abutment surface of the collet body the piston collet will shift downward. When the piston collet moves downward position, the collet fingers of collet body collapse so that splined features on the collet fingers of the collet body align and collapse into slots on the piston collet to release the collet body from the bottom sub and thus the bottom hole assembly from the pipe string.

DESCRIPTION OF THE EMBODIMENTS

Figure 1:
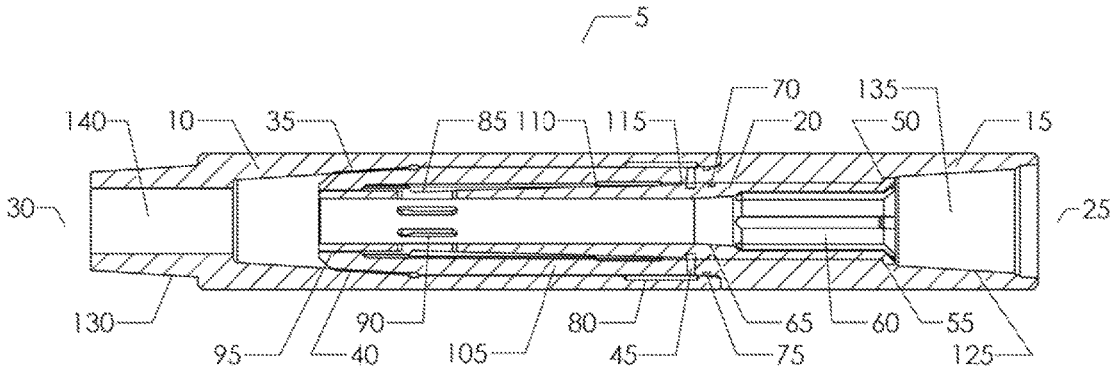
FIG. 1 is a longitudinal cross-sectional view of the downhole separation apparatus.
Figure 2:
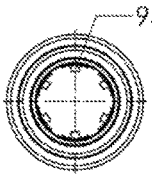
FIG. 2 is an end view of the collet body of the downhole separation apparatus shown in FIG. 1.
Figure 3:
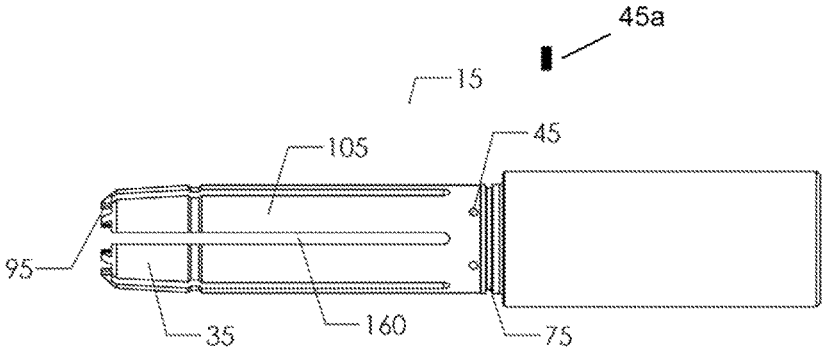
FIG. 3 is an elevation view of the collet body of the downhole separation apparatus shown in FIG. 1.

FIGS. 1-3 show an embodiment Of the downhole separation apparatus (5) of the present invention having hydraulic separation mechanism that provides a means to separate a pipe string comprising an upper pipe string portion and a lower pipe string portion or bottom hole assembly (BHA) should such a need arise. The apparatus (D) has an upper end (25) and lower end (30) configured for threadable attachment between a pipe string and a bottom hole assembly (BHA) deployed in a wellbore. The pipe string will have a central bore through which fluid may be introduced and it may be comprised of a string of tubular pipe segments or it may be a coiled tubing suing. The apparatus (5) is positioned and threadably attached to the pipe string so that apparatus (5) will extend longitudinally along the longitudinal axis of the pipe string.

FIG. 1, a longitudinal cross-sectional view of the downhole separation apparatus (5), illustrates the position of the components of apparatus (5) in the latched or connected configuration. The apparatus (5) is comprised of a collet body (15) and a lower tubular bottom sub (10). The collet body (15) has a threaded connection (125) configured to threadable attachment to the upper portion of the pipe string. The lower tubular bottom sub (10) has a threaded connection (130) configured to threadable attachment to the lower bottom hole assembly (BHA).

The collet body (15) and bottom sub (10) have central bores, (135) and (140) respectively, in communication with the central bore of the pipe string. The collet body (15) and bottom sub (10) are threadably connected to each other by means of box connection (40) of bottom sub (10) and pin connection (35) of collet body (15). Collet body (15) also has a plurality of collect fingers (105) with internal splined features (95). Seal (75) prevents fluid from entering or exiting through abutting faces of collet body (15) and bottom sub (10).

Positioned within the collet body (15) and bottom sub (10) is a tubular piston collet (20). Piston collet (20) has an upper radially outwardly extending latching shoulder (50) comprised to a plurality collet fingers (60), radial slots (90), and external splined groove features (100). Piston collet (20) is axially aligned with collet body (15) and bottom sub (10) with the latching shoulder (50) in contact with the internal radial abutment surface (55) of collet body (15). The annulus between piston collet (20) and the internal surface of collet body (15) is sealed by seal (70). The splined groove features (100) of piston collet (20) interlock with spline features (95) of the collet body (15) to prevent rotational movement of piston collet (20) within collet body (15) and the slots (90) are configured to receive the spline features (95) of the collet body (15) when piston collet is shifted along the collet body.

The engagement of collet fingers (60) of shoulder (50) of piston collet (20) with abutment surface (55) of collet body (15) will retain the piston collet (20) in place without relying on shear screws which are used with many current downhole separation devices. Retaining the piston collet (20) in place by engagement of shoulder (50) and surface (55) allows the downhole separation apparatus (5) and the pipe string to be jarred during operations while reducing the likelihood of premature separation of the BHA from the pipe string. Often such premature separation of a tool separation device is due to connection failure caused when a shear pin (or screw) is sheared as the pipe string is jarred.

Figure 3A:
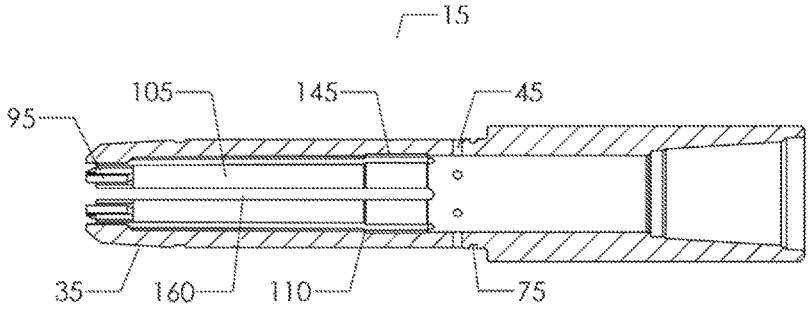
FIG. 3A is a longitudinal cross-sectional view of the collet body of the downhole separation apparatus shown in FIG. 1.

FIG. 3 and FIG. 3*a* show the collet body (15) with the plurality of collet fingers (105) and slits (160), lower pin threads (35), and radially extending splined features (95). The collet fingers (105) have an internal undercut (145) and abutment shoulder (110). Undercut (145) is provided as a way to allow fluid to travel around seal (70), between piston collet (20) and collet body (15), once the piston collet (20) has been shifted downward. Slits (160) allow collet fingers (105) to collapse, releasing pin threads 35) of collect body (15) from internal threads (40) on bottom sub (10) to separate the bottom sub (30) from collet body (15), thus separating downhole separation apparatus (5). Abutment shoulder (110) provides a lower abutment surface for engaging shoulder (50) of piston collet (20) to retain piston collet (20) within collet body (15) after piston collet (20) has shifted downward.

In another embodiment, a plurality of shear screws (45*a*) shown in FIG. 3 can be optionally placed radially around the collet body at locations (45). These screws (45*a*) at location (45) may be provided, as a supplement to securing piston collet (20) in place by engagement of shoulder (50) of piston collet (20) with abutment surface (55) of collet body (15) and will aid in holding piston collet. (20) in the correct location to keep the collet fingers (105) of collet body (15) from collapsing.

Figure 4:
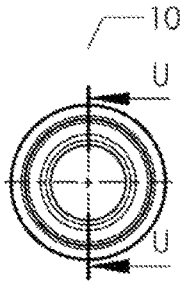
FIG. 4 is an end view of the bottom sub of the downhole separation apparatus shown in FIG. 1.
Figure 5:
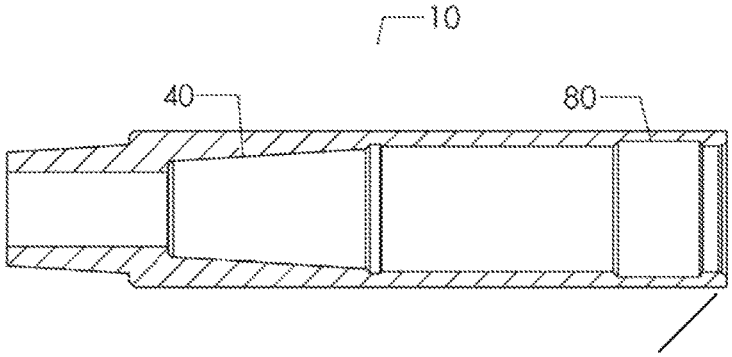
FIG. 5 is a longitudinal cross-sectional view of the bottom sub of the downhole separation apparatus shown in FIG. 1 cut through lines through lines U-U of FIG. 4.

FIG. 4, a bottom end view of the bottom sub (10), and FIG. 5, a longitudinal cross-sectional view of the bottom sub (10) along section line U-U of FIG. 4, show the internal threads (40) of the bottom sub (10) and an optional internal recess (80) at the upper end (30*a*) of the bottom sub. The internal recess (80) may be provided as a means for connecting the bottom sub to a fishing tool, such as a commonly utilized fishing tool known as a "GS" pulling tool. A GS pulling tool provides a means to engage and disengage the bottom sub (10) after the bottom sub (10) has been left in a wellbore. This recess (80) provides no benefit to the connection or separation of the collet body (15) from the bottom sub (10).

Figure 6:
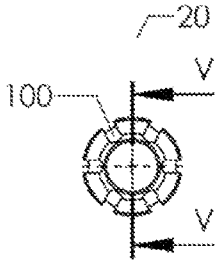
FIG. 6 is an end view of the piston collet of the downhole separation apparatus shown in FIG. 1.
Figure 7:
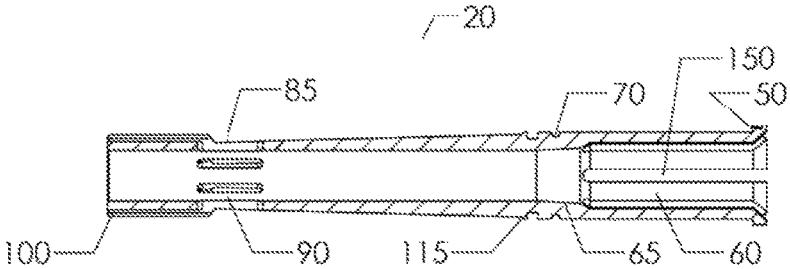
FIG. 7 is a longitudinal cross-sectional view of the piston collet of the downhole separation apparatus shown in FIG. 1 cut through lines V-V of FIG. 6.

FIG. 6, a bottom end view of the piston collect (20) and FIG. 7, a longitudinal cross-sectional view of the piston collet (20) along section line V-V of FIG. 6, show latching shoulder (50), the collet fingers (60), groove features (100), slits (150) between the collet fingers (60), circulation ball seat (65), sealing element (70), abutment shoulder (115), and slots (90). The piston collet (20) is shown to have six collet fingers (60) but there may be of any number greater than one. The collet fingers (60) may be biased radially outward to facilitate engagement of the shoulder (50) with the abutment surface (55) of the collet body (15).

The latching shoulder (50) of piston collet (20) holds against abutment shoulder (55) of collet body (15) until a circulation ball is pumped through the pipe string or coiled tubing string and lands on seat (65) inside the piston collet (20) to create a fluid pressure on the piston collet that collapses the collet fingers (60) to disengage the piston collet from the abutment shoulder (55). The amount of force required to downwardly shift the collet piston (20) while collapsing the collet fingers (60) inward from abutment surface (55) of the collet body (15) can be varied by altering the number and or length of slits (150), the thickness of each of the fingers of the collet (20), and the angle of latching shoulder (50) with a corresponding angle on shoulder (55) in collet body (15)). This force can be adjusted to suit the particular application.

Figure 9:
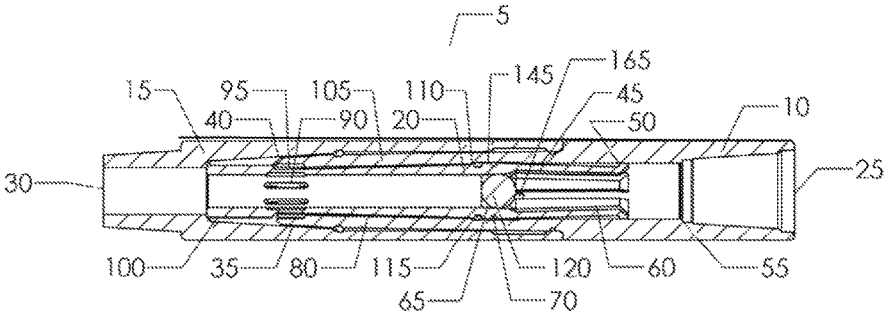
FIG. 9 is a longitudinal cross-sectional view of the downhole separation apparatus shown in FIG. 1 after the piston collet has shifted into the released position.

The abutment shoulder (115) of the piston collet (20) limits axial travel of the piston collet (20) upon separation but allows the piston collet (20) sufficient downward axial travel to place the smaller diameter (85) of piston collet (20) below the lower end of collet body (15) so that the collet fingers (105) can collapse, as seen in FIG. 9. The abutment shoulder (115) also prevents the piston collet (20) from exiting the collet body (15) upon separation. This ensures that all components separation apparatus are removed from the wellbore upon separation except the bottom sub (10). This is an advantage as it allows an operator to circulate through the bottom sub (10) and subsequently through the BHA after separation.

Use of the piston collet (20) gives the downhole separation apparatus (5) the ability to withstand repeated jarring impacts as is well known in the art) while substantially reducing the potential for premature separation of the BHA from the pipe string and without the use of shear screws that are typically employed to retain a piston assembly in place in other downhole separation devices.

Another advantage of the piston collet (20) of separation apparatus (5) is that piston collet (20) does not have to be collapsed for assembly or disassembly of the apparatus (5). This eliminates the need for special tooling to collapse the fingers (60) of the collet (20).

For assembly of the downhole separation apparatus (5), the piston collet (20) is inserted into the collet body (15) until shoulder (50) of piston collet (20) contacts shoulder (55) of bottom collet body (15). Splined features (95) of collet body (15) are aligned with groove features (100) of piston collet (20) while piston collet (20) is inserted into collet body (15). Collet body (15) is then inserted into bottom sub (10) and threadably attached via threads (35) and (40) of the collet body (15) and bottom sub (10). The shear screws (45*a*) can then be inserted if being utilized. The downhole separation apparatus (5) is now complete.

Figure 8:
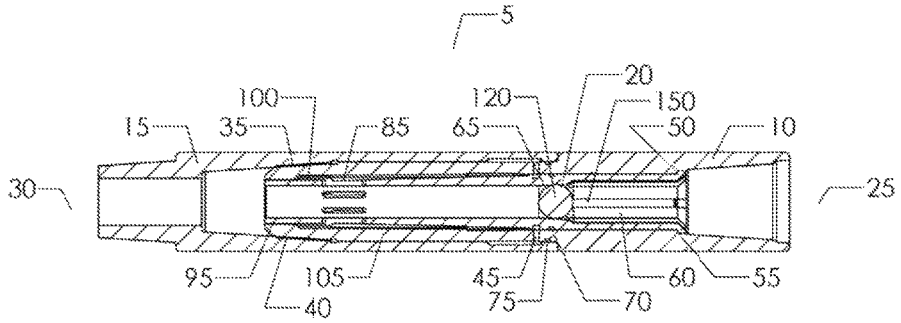
FIG. 8 is a longitudinal cross-sectional view of the downhole separation apparatus shown in FIG. 1 at the moment the circulation ball lands on seat inside the piston collet.
Figure 10:
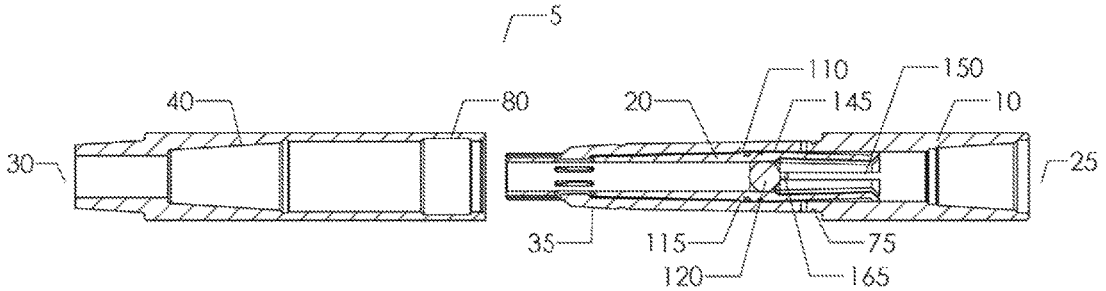
FIG. 10 is a longitudinal cross-sectional view of the downhole separation apparatus shown in FIG. 1 after complete separation from an attached pipe or coiled tubing string tool or BHA.

FIGS. 8-10 show the sequence of disengagement of the BHA from the pipe or coiled tubing string by means of the downhole separation apparatus (5) described herein. When an operator desires to release the pipe string or coiled tubing string from the BHA, a circulation ball (120) of the correct size is pumped down the central bore of the pipe string. The ball (120) will continue until down the bore of the pipe string until it reaches the ball seat (65) inside the piston collet (20) wherein it will be retained from further passage and begin restricting fluid passage there through.

FIG. 8 shows a longitudinal cross-sectional view of the downhole separation apparatus (5) in the connected state at the moment the circulation ball (120) lands on seat (65) inside the piston collet (20). When the circulation ball (120) is seated on seat (65) an operator will see an increase in pump (circulation) pressure. The pump (circulation) pressure will continue to increase until the hydraulic forces created from the fluid pressure exceeds the force holding the piston collet (20) in place and the piston collet (20) will be forced downward with respect to the pipe string.

As shown in FIG. 9, the piston collet (20) will move axially downward until abutment shoulder (115) of piston collet (20) encounters shoulder (110) of collet body (15). When the piston collet (20) moves to this downward position, the collet fingers (105) of collet body (15) are allowed to collapse. Splined features (95) of collet body (15) are then aligned and collapse into slots (90) of piston collet (20). At this time sealing element (70) of piston collet (20) aligns with internal groove (145) such that sealing element (70) is no longer effective. Simultaneously, drain ports (165) are created when slits (150) a the piston collet (20) overlap slits (160) of the collet body (15). Drain ports (165) allow fluid to continue to circulate through the downhole separation apparatus (5), causing the pressure to drop. This decrease in pressure indicates to the operator that the piston collet (20) has shifted and that the downhole separation apparatus (5) can now be separated as seen in FIG. 10.

When a tensile load is applied to the pipe string, by pulling the pipe string from the surface or otherwise, the collet body (15) of the downhole separation apparatus (5) is separated from the bottom sub (10) as shown in FIG. 10. Upon such separation, the collet body (15), piston collet (20) and circulation ball (120) may then be removed from the wellbore with the pipe string while the bottom sub (10), with the still attached BHA, is left behind.

Figure 11:
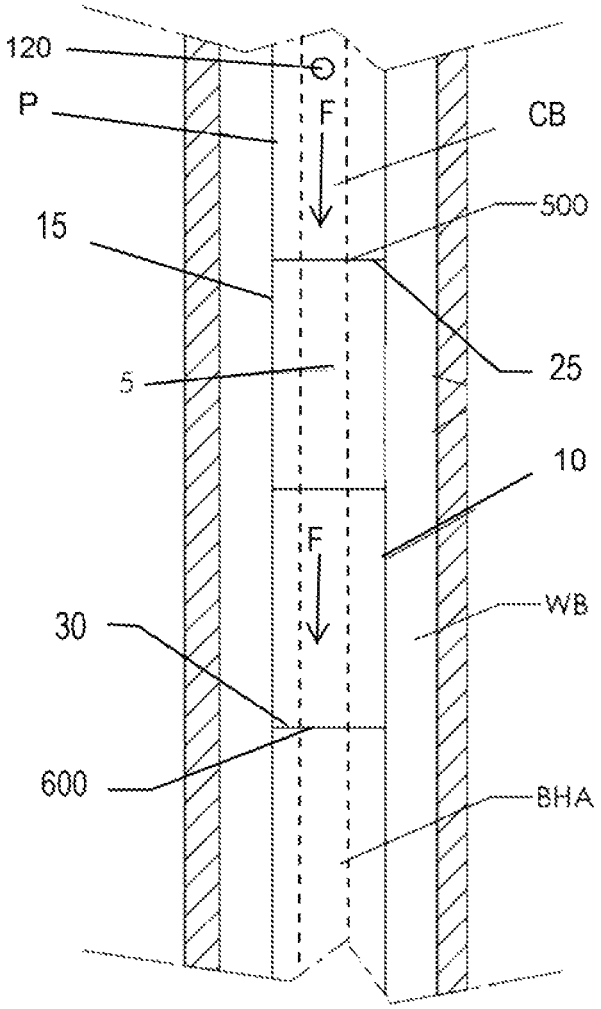
FIG. 11 is a longitudinal cross-sectional view of a wellbore showing the downhole separation apparatus of FIG. 1 attached to a pipe string.

FIG. 11 shows the downhole separation apparatus (5) positioned on and threadably attached to a pipe or coiled tubing string (P) between the downhole end (500) of pipe string (P) and a bottom hole assembly (BHA). The downhole end (500) of pipe string (P) is attached to the apparatus (5) by means of upper threaded connection (125) at the top (25) of the collet body (15). The uphole end (600) of bottom hole assembly (BHA) is attached to the downhole separation apparatus (5) by means of threaded connection (130) at the bottom (30) of bottom sub (10). The sequence of connecting the pipe or coiled tubing string (P) and the bottom hole assembly (BHA) to the downhole separation apparatus (5) may be altered as desired. After such assembly, the pipe or toiled tubing string (P) with the attached downhole separation apparatus (5) and the attached BHA may be inserted into wellbore (WB) for use. In use circulation ball (120) is inserted into the separation apparatus (5) through the central bore (CB) of the pipe string (P) where it travels by circulation of fluid (F) until it reaches the ball seat (65) inside the piston collet (20) to active the separation apparatus.

It is thought that the downhole separation apparatus (5) presented herein as well as its attendant advantages will be understood from the foregoing description and it will be apparent that various changes may be made in the form, construction and arrangement of the parts thereof without departing from the spirit and scope of the invention or sacrificing all of its material advantages, the form described herein being merely art example embodiment of the invention.

I claim:

1. A downhole separation apparatus comprising:

(a) a tubular collet body having an internal abutment surface;

(b) a tubular bottom sub having an internal profile corresponding to the external profile of said collet body;

(c) a tubular piston collet positioned within said collet body, said piston collet having a shoulder releaseably engaged with said internal abutment surface of said collet body, and said piston collet having an internal profile whereby a circulation ball will seat and block a circulation of fluid through said piston collet thereby increasing fluid pressure to release said piston collet to travel axially within said collet body; and (d) a plurality of collet fingers on said collet body releaseably engaged with an internal profile of said bottom sub.

2. The downhole separation apparatus recited in claim 1 wherein said plurality of collet fingers on said collet body are disengaged from said internal profile of said bottom sub by said axial travel of said piston collet within said collet body.

3. The downhole separation apparatus recited in claim 2 further comprising:

(a) a plurality of splines on said collet body; and (b) a plurality of splines on said piston collet interlocked with said splines on said collet body thereby preventing rotational movement of said piston collet within said collet body.

4. The downhole separation apparatus recited in claim 3 further comprising a plurality of slots in said piston collet, each of said slots positioned to receive a corresponding spine of said plurality of splines on said collet body upon said axial travel of said piston collet.

5. The downhole separation apparatus recited in claim 4 wherein said radially outwardly extending shoulder of said piston collet is comprised of a plurality of collet fingers.

6. The downhole separation apparatus recited in claim 5 further comprising:

(a) a threaded connection at the upper end of said collet body threadedly engaged with a tubular pipe string; and (b) a threaded connection at the lower end of said bottom sub threadedly engaged with a bottom hole assembly.

7. The downhole separation apparatus recited in claim 6, further comprising an internal recess in said tubular bottom sub whereby a fishing tool may be engaged and disengaged.

8. A method for separating a bottom hole assembly from a pipe string comprising the steps of:

(a) providing downhole separation apparatus comprising a tubular collet body; a tubular bottom sub having an internal profile corresponding to the external profile of said collet body; a piston collet positioned within said collet body; said piston releasably retained by an interior abutment surface within said collet body, said piston collet having an internal profile for seating a circulation ball; and a plurality of collet fingers on said collet body threadedly engaging and internal profile of said bottom sub; a threaded connection at the upper end of said collet body; and a threaded connection at the lower end of said bottom sub;

(b) connecting a pipe string to said threaded connection at the upper end of said collet body;

(c) connecting a bottom hole assembly to said threaded connection at the lower end of said bottom sub;

(d) placing said pipe string with said downhole separation apparatus and said bottom hole assembly into a wellbore;

(e) pumping a circulation ball down said pipe string until said circulation ball is seated on said internal profile of said piston collet when separation of said bottom hole assembly is desired; and (f) increasing fluid pressure in said pipe string thereby exceeding the force holding said piston collet in place within said collet body whereby said piston collet moves downward to collapse said plurality of collet fingers on said collet body to disengage said plurality of collet fingers from said internal profile of said bottom sub thereby separating said bottom hole assembly from said pipe string.

9. The method as recited in claim 8 further comprising the step of applying a tensile load to said pipe string.

10. The method as recited in claim 9 further comprising the step of reattaching said pipe string with said attached collet body and said piston collet within said wellbore.

11. The method as recited in claim 9 further comprising the step of removing said pipe string with said attached collet body, said piston collet, and said circulation ball from said wellbore with said bottom sub and said attached bottom hole assembly left behind.

12. The method as recited in claim 11 further comprising the step of providing an internal recess in said tubular bottom sub whereby a fishing tool may be engaged and disengaged.

13. A downhole separation apparatus comprising:

(a) a pipe string having a central bore;

(b) a tubular collet body having a central bore in communication with said central bore of said pipe string, said collet body having an upper end attached to said pipe string, an internal abutment surface, and a plurality of collet fingers having a threaded external profile;

(c) a tubular piston collet positioned within said collet body, said piston collet having a central bore in communication with said central bore of said pipe string, a radially outwardly extending shoulder comprised of a plurality of collet fingers releaseably engaged with said internal abutment surface of said collet body, and an internal circulation ball seat;

(d) a bottom hole assembly having a central bore in communication with said central bore of said piston collet;

(e) a tubular bottom sub having a lower end attached to said bottom hole assembly and a threaded internal profile releaseably attached to said threaded external profile of said plurality of collet fingers of said collet body; and (f) a circulation ball configured for insertion into said collet piston through said pipe string.

14. The downhole separation apparatus recited in claim 13 further comprising:

(a) a plurality of splines on said collet body; and (b) a plurality of splines on said piston collet interlocked with said splines on said collet body thereby preventing rotational movement of said piston collet within said collet body.

15. The downhole separation apparatus recited in claim 14 wherein said circulation ball is seated on said circulation ball seat blocking circulation of fluid through said piston collet thereby increasing fluid pressure to release said piston collet to travel axially within said collet body.

16. The downhole separation apparatus recited in claim 15 wherein said plurality of collet fingers of said collet body are disengaged from said internal profile of said bottom sub by said axial travel of said piston collet within said collet body.

17. The downhole separation apparatus recited in claim 16 further comprising a plurality of slots in said piston collet, each of said slots positioned to receive a corresponding spine of said plurality of splines on said collet body upon said axial travel of said piston collet.

18. The downhole separation apparatus recited in claim 17, further comprising an internal recess in said tubular bottom sub whereby a fishing tool may be engaged and disengaged.

19. The downhole separation apparatus recited in claim 18, further comprising a plurality of shear screws attaching said piston collet to said collet body.

* * * * *